US006031920A

United States Patent [19]

Wiener

[11] Patent Number: 6,031,920

[45] Date of Patent: Feb. 29, 2000

[54] COAXIAL DUAL-PARABOLIC SOUND LENS SPEAKER SYSTEM

[76] Inventor: David Wiener, 10 Iron Canyon Ct., Park City, Utah 84060

[21] Appl. No.: 08/857,351

[22] Filed: May 16, 1997

[51] Int. Cl.[7] ..... H04R 25/00

[52] U.S. Cl. ..... 381/160; 381/186; 381/182

[58] Field of Search ..... 381/336, 182, 381/186, 160, 386, 352, FOR 160, 359, 189; 181/155, 175, 176

[56] References Cited

U.S. PATENT DOCUMENTS

| | | | |
|---|---|---|---|
| 1,120,858 | 12/1914 | Stallforth | 181/30 |
| 1,272,843 | 7/1918 | Pape | 381/160 |
| 2,228,024 | 1/1941 | Abrahams | 181/26 |
| 2,643,727 | 6/1953 | Leon | 181/31 |
| 3,647,284 | 3/1972 | Elings et al. | 350/294 |
| 3,776,361 | 12/1973 | Rolle | 181/0.5 A |
| 3,832,888 | 9/1974 | Langlois | 73/67.5 H |
| 3,895,188 | 7/1975 | Ingraham | 179/1 MF |
| 3,908,095 | 9/1975 | Jinsenji | 179/102 |
| 4,421,200 | 12/1983 | Ferralli et al. | 181/144 |
| 4,629,030 | 12/1986 | Ferralli | 181/155 |
| 4,801,941 | 1/1989 | Sabet-Peyman | 342/378 |
| 4,836,328 | 6/1989 | Ferralli | 181/155 |
| 4,964,100 | 10/1990 | Srour et al. | 367/178 |
| 4,967,873 | 11/1990 | Hacchow et al. | 181/176 |
| 5,033,456 | 7/1991 | Pell et al. | 128/24 EL |
| 5,050,436 | 9/1991 | Kunii et al. | 73/644 |
| 5,199,075 | 3/1993 | Fosgate | 381/24 |
| 5,220,608 | 6/1993 | Pfister | 381/17 |
| 5,268,539 | 12/1993 | Ono | 181/155 |
| 5,532,438 | 7/1996 | Brown | 181/155 |

FOREIGN PATENT DOCUMENTS

| | | | |
|---|---|---|---|
| 0 500 294 A2 | 8/1992 | European Pat. Off. | H04R 5/02 |
| 3902062A1 | 1/1989 | Germany | H04R 1/34 |
| 2291798 | 3/1990 | Japan | H04R 1/34 |
| 2237297 | 9/1990 | Japan | H04R 1/34 |

OTHER PUBLICATIONS

Secret Sound® —The Unique Directional Speaker System sales brochure from Museum Tools, at least as early as Apr., 1991.

*Primary Examiner*—Curtis A. Kuntz
*Assistant Examiner*—Dionne N. Harvey
*Attorney, Agent, or Firm*—David P. Gordon; David S. Jacobson; Thomas A. Gallagher

[57] ABSTRACT

A sound focusing speaker system includes a sound focusing lens having an upper parabolic portion and a coaxial lower parabolic portion, each defined by different parabolic equations. A conical skirt is also provided adjacent the lower parabolic portion, and a lower lip is provided around the conical skirt. A speaker driver system is provided within the sound focusing lens. The speaker system includes a high frequency driver, a low frequency driver, and a sound dispersion lens into which the low frequency driver fires. The high frequency driver is vertically aligned with the focus of the upper parabolic portion, and a central portion of the sound dispersion lens is vertically aligned with the focus of the lower parabolic portion. The conical skirt contains reflected waves. The coaxial dual parabolic sound focusing speaker system is optimized to accurately reproduce a broad frequency spectrum of sound and to reflect the sound into a substantially vertical beam. As a result, optimal sound reproduction is provided and the sound is confined to a relatively controlled vertical beam. A second embodiment is provided in which the sound focusing lens is provided with an internal baffle to partially separate two halves of the sound focusing lens. The sound focusing lens may be used with stereo speaker drivers to provide two beams of sound and providing stereo sound imaging.

22 Claims, 4 Drawing Sheets

COAXIAL DUAL-PARABOLIC SOUND LENS SPEAKER SYSTEM

BACKGROUND OF THE INVENTION

1. Field of the Invention

This invention relates broadly to audio speaker systems. More particularly, this invention relates to a sound focusing lens used with an audio speaker system to focus sound.

2. State of the Art

A number of speaker systems are known for focusing sound. Sound focusing speakers use a concave lens and a speaker directed into the concave lens. Ideally, the lens reflects sound from the speaker such that the sound reflected is confined to a desired area. These speaker systems have particular application where it is desired to prevent sound emitted by one speaker system from interfering with sound emitted by another speaker system. In addition, these speaker systems are useful for "listening stations" where it is desired that only listeners at a "listening station" be able to hear the sound from the speaker system.

U.S. Pat. No. 5,268,539 to Ono discloses a partial ellipsoid sound lens having a speaker system at one focus of the lens. Proper placement of the speaker system at one focus results in the sound being reflected by the lens and focusing at the second focus of the ellipse, where the listener is positioned. Unless a listener has his or her ears located at the second focus, listening will not be optimal. In addition, because sound is reflected back toward the second focus from many angles, sound will overshoot the second focus, and failing to be contained, will strike floor surfaces and disperse. The dispersion of sound will provide auditory interference to others in the vicinity of the ellipsoid sound lens.

U.S. Pat. No. 5,532,438 to Brown discloses a sound lens speaker system similar to the Ono system. The Brown system includes a spherical dome and a speaker directed into the dome. The speaker is angled such that sound from the speaker reflects off the inside of the dome and is purportedly focused at the listeners ears. The Brown system suffers from the same drawbacks as the Ono system. The ears of the listener must be particularly positioned at a particular height relative to the dome to accurately hear the reflected sound. In addition, the angled speaker will cause sound to spill over outside the spherical dome. Furthermore, the spherical shape of the dome will likely further propagate uncontrolled sound scatter outside the dome.

Museum Tools of San Rafael, Calif., offers a sound lens speaker system under the name Secret Sound® which includes a parabolic sound lens and a speaker located at the focus of the parabolic lens. The speaker radiates sound upward into the sound lens and the sound lens then focuses the sound into a substantially vertical beam of sound, thereby reducing the amount of sound which is uncontrollably scattered. However, contrary to the Secret Sound® literature, the Secret Sound® sound lens is not designed to handle a full spectrum of humanly audible sound. The curvature and size of the parabolic lens is not optimized to accurately reflect both high and low frequency sound waves.

SUMMARY OF THE INVENTION

It is therefore an object of the invention to provide a focused sound speaker system having a sound lens designed to optimally reflect a broad spectrum of sound frequencies.

It is another object of the invention to provide a focused speaker system having speakers for reproducing a broad frequency spectrum of sounds.

In accord with these objects which will be discussed in detail below, a sound lens speaker system is provided which includes a concave sound focusing lens having an upper parabolic portion and a coaxial lower parabolic portion. The upper and lower parabolic portions are defined by different parabolic equations, such that the upper parabolic portion is designed to reflect higher frequency sound waves and the lower parabolic portion is designed to reflect relatively lower frequency sound waves. Preferably, a conical skirt is also provided adjacent the lower parabolic portion, and a lower lip is provided around the conical skirt.

A speaker driver system is provided within the sound focusing lens. According to a preferred aspect of the invention, the speaker driver system includes an upper high frequency pod having an upper frequency driver, a lower mid/low frequency pod having a mid/low frequency driver, and a sound dispersion lens between the upper and lower pods. The mid/low frequency driver fires sound waves into the sound dispersion lens which reflects the sound waves laterally into the sound focusing lens. Sound waves from the tweeter and mid/low drivers are reflected by the sound focusing lens into a downward substantially vertical beam of sound.

The speaker system is preferably positioned within the sound focusing lens such that the high frequency driver(s) is substantially vertically aligned with the focus of the upper parabolic portion, and a central portion of the sound dispersion lens is approximately vertically aligned with the focus of the lower parabolic portion. The conical skirt is provided to prevent reflected waves from randomly scattering out of the opening of the sound focusing lens.

The coaxial dual parabolic sound focusing speaker system is optimized to accurately reproduce a broad frequency spectrum of sound and to reflect the sound into a substantially vertical beam. As a result, the sound focusing speaker system of the invention provides an optimal sound reproduction system where it is desirable to produce high quality sound and confine the sound to a relatively controlled vertical beam.

A second embodiment is also provided in which the sound focusing lens is provided with an internal baffle to partially separate two halves of the sound focusing lens. The sound focusing lens may be used with stereo speaker drivers to provide two beams of sound which may be imaged in stereo.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
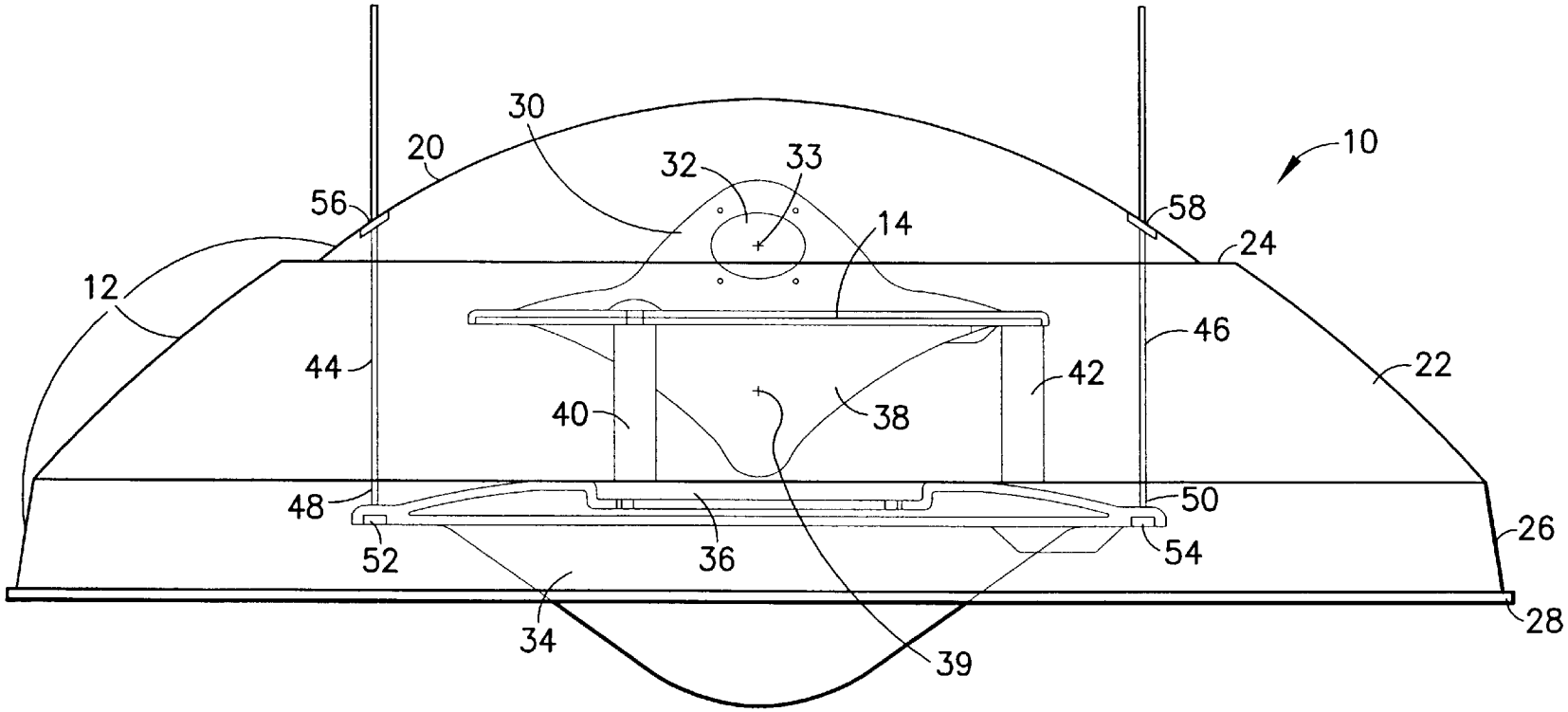
FIG. 1 is a transparent side elevation view of a dual-parabolic sound lens speaker system according to a first embodiment of the invention.
Figure 2:
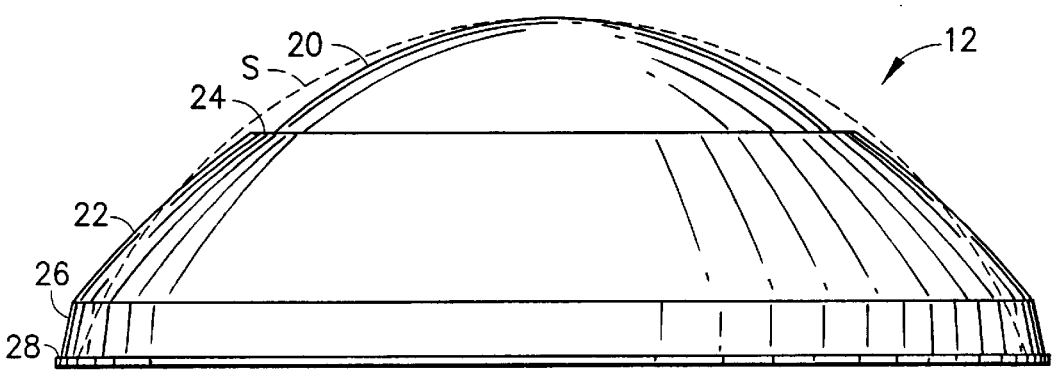
FIG. 2 is a side elevation view of a dual-parabolic sound lens according to the first embodiment of the invention.
Figure 3:
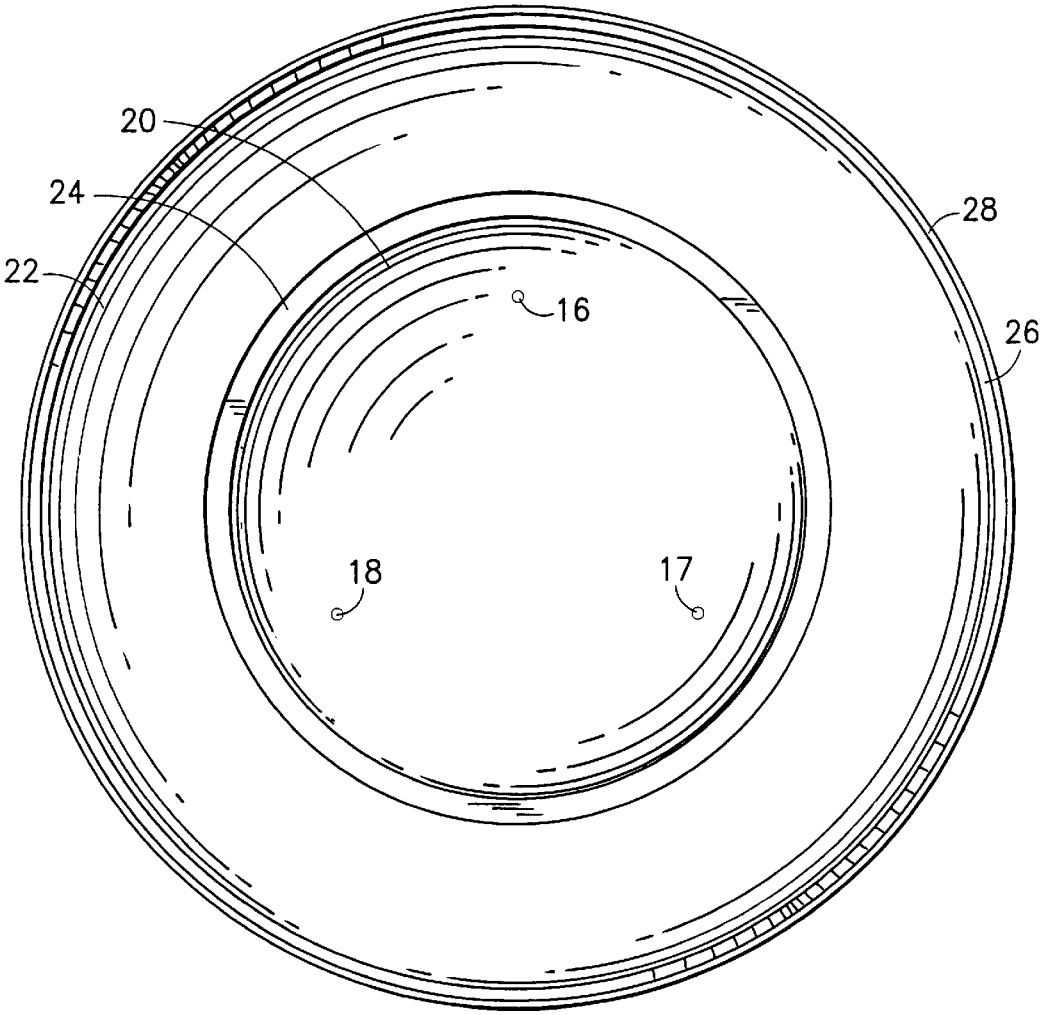
FIG. 3 is a bottom view of the dual-parabolic sound lens of FIG. 2.

Referring to FIG. 1, a dual-parabolic sound lens speaker system 10 according to a first embodiment is shown. The sound lens speaker system 10 generally includes a concave sound focusing lens 12 and a speaker driver assembly 14 partially surrounded by the sound focusing lens. Turning to FIGS. 2 and 3, in conjunction with FIG. 1, and according to a preferred aspect of the invention, the sound focusing lens 12 has an upper parabolic portion 20 and a coaxial lower parabolic portion 22. The upper and lower portions 20, 22 are defined by different parabolic equations, such that a non-spherical contour is provided (a spherical contour being shown by broken line S in FIG. 2). The upper and lower parabolic portions preferably meet at a substantially planar and horizontal step 24. Preferably, a conical skirt 26 is also provided adjacent the lower parabolic portion 22, and a lower lip 28 is provided around the conical skirt 26. The sound focusing lens 12 preferably includes three upper holes 16, 17, 18 (FIG. 3) which are used to assemble the sound focusing lens and speaker driver assembly, as described below. The sound focusing lens 12 is preferably made from acrylic.

The upper parabolic portion 20 is optimized to reflect higher frequency sound waves, while the lower parabolic portion 22 is optimized to reflect relatively lower frequency sound waves. To that end, the upper parabolic portion has a "tighter" curvature than the lower parabolic portion, and, according to the standard equation for a parabola, $x^2=2py$, where the point (0,p) is the focus, the value of p for the upper parabolic portion is less than the value of p for the lower parabolic portion.

Turning back to FIG. 1, and according to a preferred aspect of the invention, the speaker driver assembly 14 includes two separate driver pods; a tweeter pod 30 preferably having three tweeter drivers (one 32 of which is shown) to reproduce high frequencies, and a mid-woofer pod 34 having a mid-woofer driver 36 to reproduce mid/low frequencies. The tweeter drivers of the tweeter pod 30 are preferably angled diagonally upward and are also preferably directed at 120° of separation from each other. The underside of the tweeter pod 30 preferably includes a sound dispersion lens 38 which reflects sound waves originating from the mid-woofer driver 36 into a direction substantially perpendicular to the direction in which the mid/woofer driver 36 fires (i.e., out toward the lower parabolic portion 22. The tweeter pod 30 is coupled to the mid-woofer pod 34, preferably using three threaded mounts, two of which 40, 42 are shown.

The tweeter pod 30 is preferably aligned within the sound focusing lens 12 such that the center 33 of the tweeter driver 32 is substantially vertically aligned with the focus of the upper parabolic portion 20. The sound dispersion lens 38 is preferably positioned such that the midpoint 39 of the height of the sound dispersion lens is substantially vertically aligned with the focus of the lower parabolic portion 22. The mid/woofer driver 36 is preferably substantially vertically aligned with the top of the conical skirt 26. The speaker driver assembly is preferably of a design similar to the omnidirectional speaker driver assembly disclosed in U.S. Ser. No. 08/410,142 to Wiener for an "Omni-Directional Loudspeaker System", which is hereby incorporated by reference herein in its entirety.

The speaker driver assembly 14 is coupled to the sound focusing lens 12 in the preferred position, as described above, by preferably using three cables, two of which 44, 46 are shown. The cables 44, 46 have threaded ends 48, 50 which extend through holes (not shown) in the mid/woofer pod 32, and the mid/woofer pod is secured to the ends 48, 50 of the cables 44, 46 using threaded nuts 52, 54 which engage the threaded ends 48, 50. The cables 44, 46 extend through the upper holes 16, 17, 18 (FIG. 3) of the sound focusing lens and stops 56, 58 are provided on the cables to position the sound focusing lens relative to the speaker driver assembly. The portion of the cables 44, 46 extending beyond the upper holes 16, 17, 18 may be used to suspend the sound lens speaker system from a ceiling or other support structure.

Figure 4:
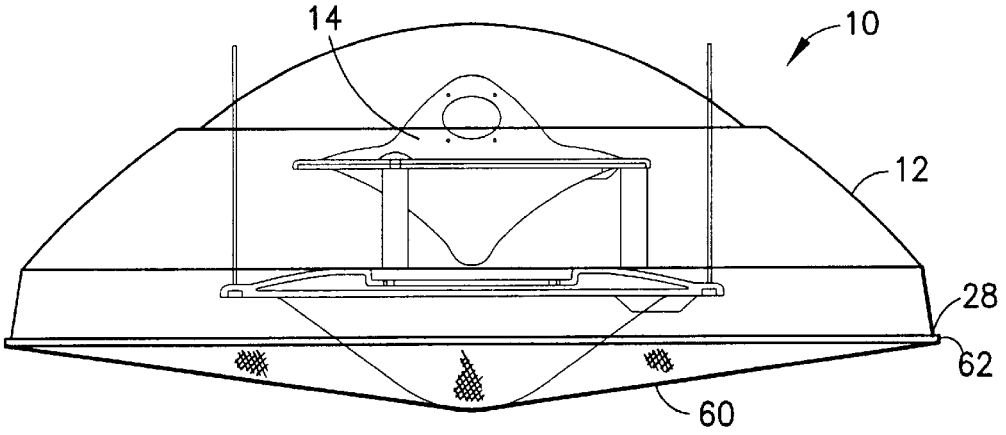
FIG. 4 is a transparent side elevation of a dual-parabolic sound lens speaker system provided with a cover according to the invention.
Figure 5:
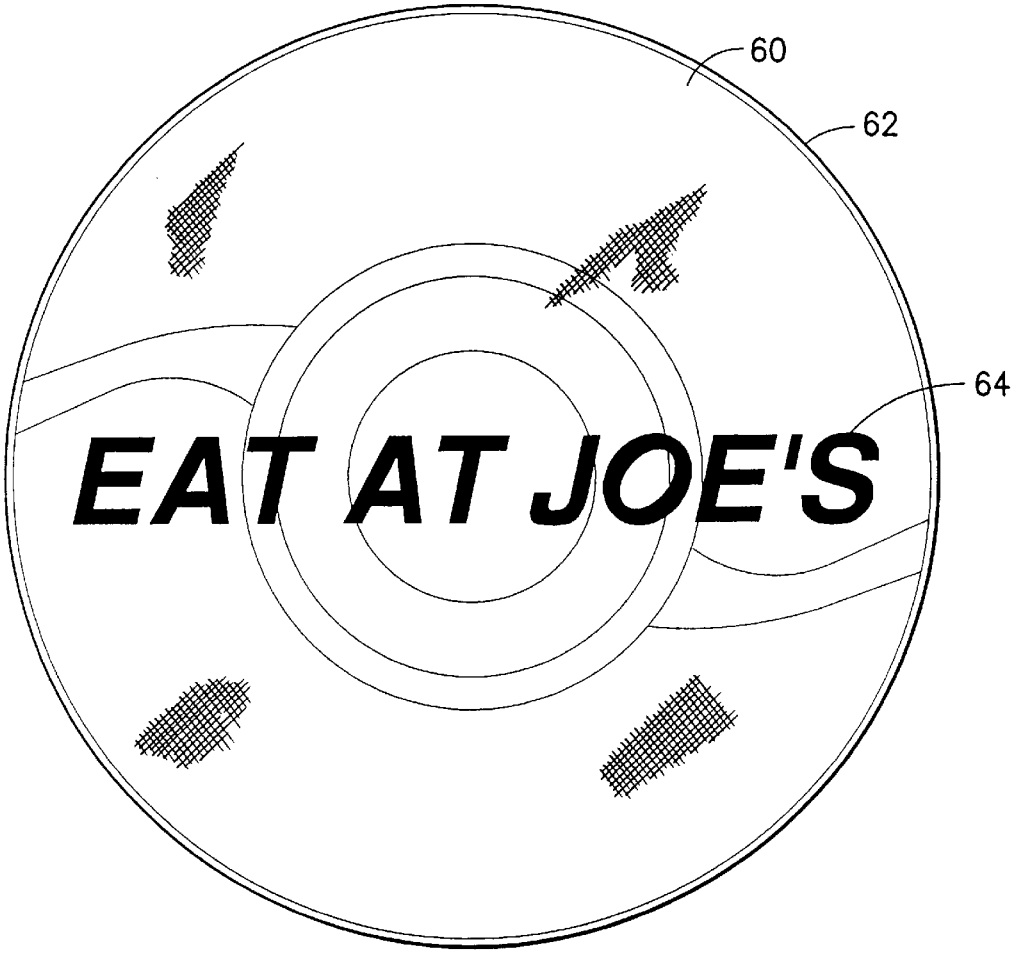
FIG. 5 is bottom view of the dual-parabolic sound lens speaker system of FIG. 4.

Turning now to FIGS. 4 and 5, a substantially circular acoustically transparent cover 60 is preferably provided over the opening of the sound focusing lens 12. The cover 60 is preferably provided with an elastic band 62 around its circumference. The cover 60 is coupled to the sound focusing lens 12 by engagement of the elastic band 62 around the lip 28 of the sound focusing lens, and stretches over the bottom of the mid/woofer pod 34. The cover 60 is preferably made of fabric and may be provided with advertising 64, and/or other text and/or illustrations.

According to a currently preferred sound focusing lens according to the first embodiment, the sound focusing lens 12 is approximately ten inches in height, and twenty-nine inches in diameter at its widest, i.e., at the lip 28. A cross-section through the center of the upper parabolic portion 20 provides a section defined by the parabolic equation $x^2=12.96y$, has a height of approximately three and a quarter inches, and a maximum diameter of approximately sixteen and three-quarter inches. A cross-section through the center of the lower parabolic portion 22 provides a section defined by the equation $x^2=25.44y$, has a height of approximately four and one third inches, and a maximum diameter of approximately twenty-seven and nine-tenths inches. The conical skirt 26 has a height of approximately two and one-third inches and a maximum diameter of approximately twenty-eight and six-tenths inches. The lip 28 is approximately two-tenths of an inch in height and in width. The step 24 joining the upper parabolic portion and the lower parabolic portion is approximately one and four-tenths inches in width.

In operation, sound from the speaker drivers is directed upward and laterally, and is reflected by the sound focusing lens substantially downward into a pseudo-columnar beam of sound waves. The upper and lower parabolic portions, with respective upper and lower foci, are designed to reflect the sound waves of the tweeter driver and mid/woofer driver, respectively. Particularly, the upper parabolic portion is designed to reflect sound waves emitted by the tweeter drivers around the mid/woofer pod, to thereby reduce any potential interference by the mid/woofer pod with the high frequency sound waves. In addition, the lower parabolic portion is designed to have a relatively larger diameter, as a larger lower parabolic portion is better able to reflect and to contain lower frequency (and longer wavelength) sound waves.

Figure 6:
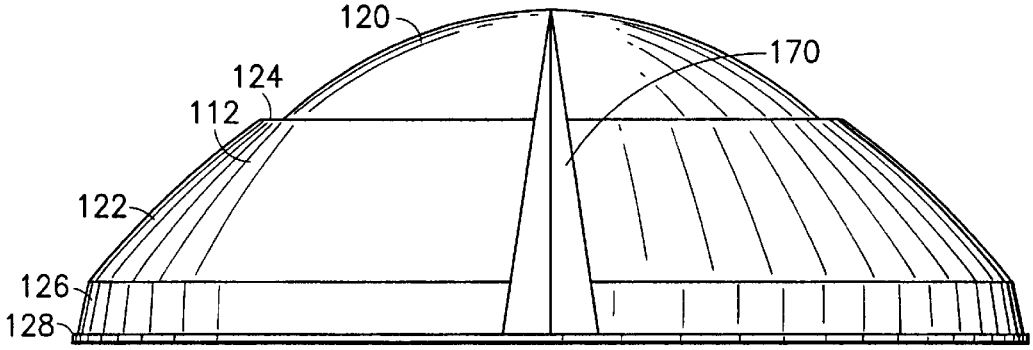
FIG. 6 is a side elevation view of a dual-parabolic sound lens according to a second embodiment of the invention.
Figure 7:
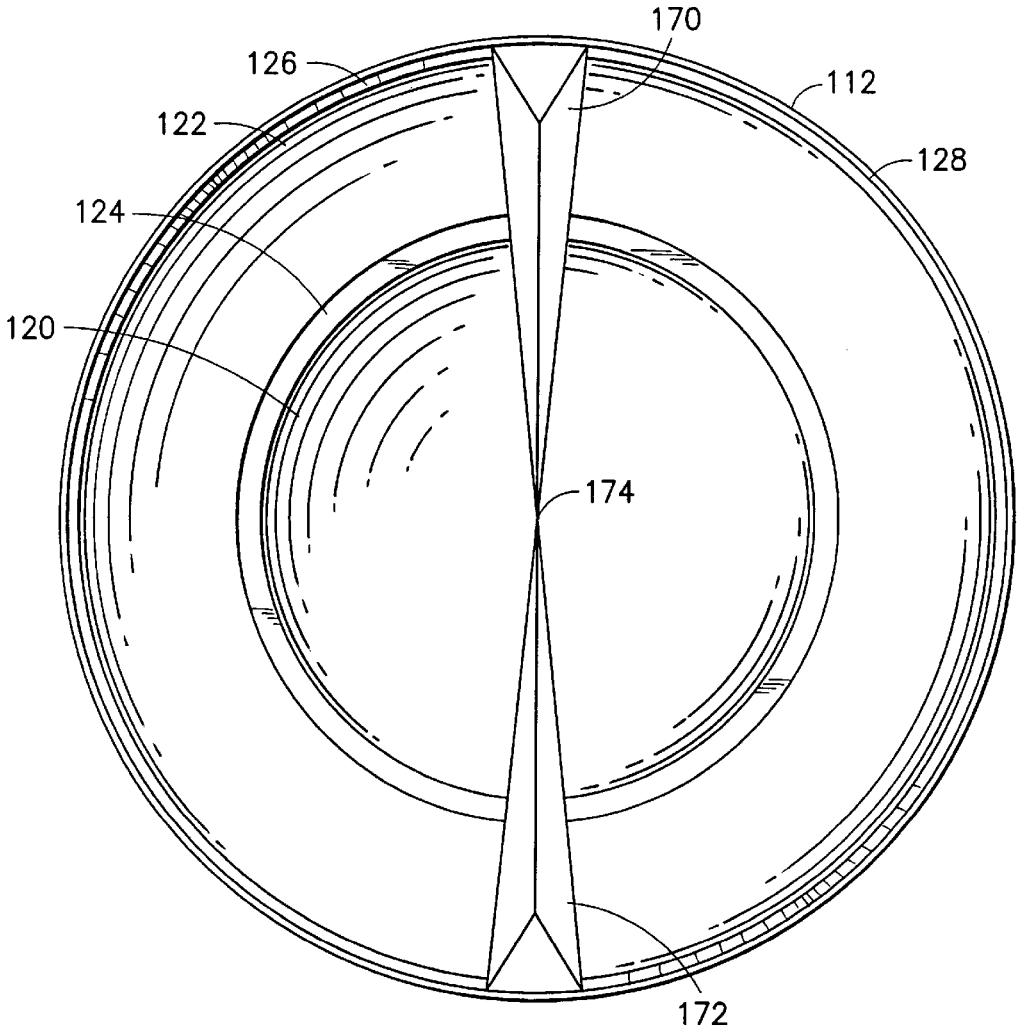
FIG. 7 is a bottom view of the dual-parabolic sound lens of FIG. 6.

Turning now to FIGS. 6 and 7 a second embodiment of a dual-parabolic sound lens speaker system 110, substantially similar to the first embodiment (with like parts having numbers incremented by 100), is shown. The sound focusing lens 112 includes an upper parabolic portion 120 and a lower parabolic portion 122 meeting at a step 124. A conical skirt 126 preferably descends around the lower parabolic portion 122, and a lip 128 preferably extends around the conical skirt 126. Two "V" or wedged-shaped baffles 170, 172 are provided on the inner surface of the sound focusing lens at 180° of separation. The baffles 170, 172 preferably meet at a point 174 at the top center of the sound focusing lens 112. The baffles 170, 172 may be integrally molded into the sound focusing lens 112, as shown, or may be constructed separately to fit the inner contour of the sound focusing lens and then attached thereto, for example, by using an adhesive. A stereo speaker driver assembly (not shown) is coupled within the sound dispersion lens 112 and directs separate left and right channel sound into the sound lens on either side of the baffles. The sound lens then focuses the sound downward toward a listener while the baffles substantially maintain signal separation. A focused stereo sound image is thereby provided to the listener.

There have been described and illustrated herein dual-parabolic sound lens speaker systems. While particular embodiments of the invention have been described, it is not intended that the invention be limited thereto, as it is intended that the invention be as broad in scope as the art will allow and that the specification be read likewise. Thus, while particular parabolic equations have been disclosed for the form of the sound focusing lens, it will be appreciated that other parabolic equations can be used for the design as well. In addition, while equations and dimensions are provided for a currently preferred embodiment, it will be appreciated that other equations may be used to define the shape of the upper and lower parabolic portions (such that the upper and lower parabolic portions have the same or a different ratio of relative size) and that other dimensions may also be used. Also, while a sound focusing lens is described as having two parabolic portions, it will be appreciated that the sound focusing lens may be provided with three or more parabolic portions, each having a shape optimized to reflect a range of sound wave frequencies. Furthermore while a particular type of speaker driver assembly has been disclosed, it will be understood that other speaker drivers may also be used. In addition, the mid/woofer pod may be provided with a port to extend low frequency dynamics. Also, while particular mounting hardware is disclosed for coupling the speaker driver assembly to the sound focusing lens, it will be recognized that other mounting hardware may used. Moreover, while a particular configuration has been disclosed in reference to the baffle for separating left and right channel audio waves, baffles of another design may be used. For example, the baffles may be substantially flat or may meet at other than a point. Furthermore, while the step between the upper and lower parabolic portions is preferred, the step is not required and a upper parabolic portion may be made relatively larger to directly meet the lower parabolic portion. In addition, while acrylic has been disclosed as a preferable material for constructing the sound focusing lens, other moldable, blowable, or otherwise formable materials may also be used. Moreover, while the term "vertical" has been used in the above description to indicate relative position and direction, it will be appreciated that the term should be construed broadly above and in the claims. That is, the dual-parabolic sound lens speaker system may be oriented off-axis by between 0° and 180°, and the relative position and orientation of components and focused sound waves will likewise be rotated by the same degree relative to their described position. It will therefore be appreciated by those skilled in the art that yet other modifications could be made to the provided invention without deviating from its spirit and scope as so claimed.

What is claimed is:

1. A sound lens speaker system, comprising:

a) a concave sound lens having an upper parabolic portion and a lower parabolic portion, a cross-section through a center of said upper parabolic portion being defined by a first parabolic equation, said upper parabolic portion being defined by revolution of a portion of a first parabola defined by said first parabolic equation about an axis of said first parabola, and a cross-section through a center portion of said lower parabolic portion being defined by a second parabolic equation different than said first parabolic equation, said lower parabolic portion being defined by revolution of a portion of a second parabola defined by said second parabolic equation about an axis of said second parabola; and b) a speaker driver assembly having a first driver means for emitting sound waves of a first frequency range into said sound lens, and a second driver means for emitting sound waves of a second frequency range into said sound lens.

2. A sound lens speaker system according to claim 1, wherein:

said upper parabolic portion has an upper focus and said lower parabolic portion having a lower focus different than said upper focus.

3. A sound lens speaker system according to claim 1, wherein:

said upper and lower parabolic portions meet at a step portion of said sound lens.

4. A sound lens speaker system according to claim 1, wherein:

said sound lens is provided with a conical portion adjacent said lower parabolic portion.

5. A sound lens speaker system according to claim 1, further comprising:

d) an acoustically transparent cover having a means for securing said cover to said sound lens, wherein said sound lens is provided with a lower opening and said cover is secured to said sound focusing lens by said means for securing such that said opening is substantially enclosed.

6. A sound lens speaker system according to claim 5, wherein:

said sound lens is provided with a lower lip, said cover is circular and has a circumference, and said means for securing is an elastic band at least partially around said circumference such that said elastic band engages said lip to secure said cover to said sound lens.

7. A sound lens speaker system according to claim 1, wherein:

said sound lens is provided with an internal baffle.

8. A sound lens speaker system according to claim 7, wherein:

said internal baffle is one of a V-shape and wedge shape.

9. A sound lens speaker system according to claim 1, wherein:

said first driver means is substantially vertically aligned with said upper focus.

10. A sound lens speaker system according to claim 2, further comprising:

d) a sound dispersion means for reflecting sound waves of said second frequency range substantially perpendicular to a direction in which said sound waves of said second frequency range are emitted by said second driver means.

11. A sound lens speaker system according to claim 10, wherein:

said sound dispersion means has a height, and a midpoint of said height is substantially vertically aligned with said lower focus.

12. A sound lens speaker system according to claim 3, wherein:

said sound lens is provided with a conical portion adjacent said lower parabolic portion and a lip around said conical portion.

13. A sound lens speaker system according to claim 12, further comprising:

d) a sound dispersion means for reflecting said sound waves of said second frequency range substantially perpendicular to a direction in which said sound waves of said second frequency range are emitted by said second driver means, said sound dispersion means having a height and said height having a midpoint, wherein said upper parabolic portion has an upper focus and said lower parabolic portion has a lower focus different than said upper focus, said midpoint of said height of sound dispersion means is substantially vertically aligned with said lower focus, said first driver means is substantially vertically aligned with said upper focus, and said second driver means is substantially vertically aligned with an intersection of said conical portion and said lower parabolic portion.

14. A sound lens, comprising:

a) an upper parabolic portion having an upper focus; and b) a lower parabolic portion having a lower focus, said upper parabolic portion being defined by revolution of a portion of a first parabola defined by a first parabolic equation about an axis of said first parabola, and said lower parabolic portion being defined by revolution of a portion of a second parabola defined by a second parabolic equation different than said first parabolic portion about an axis of said second parabola, said first and second parabolic portions cooperating to form a substantially continuous inner surface.

15. A sound lens according to claim 14, further comprising:

c) a substantially planar step portion joining said upper and lower parabolic portions.

16. A sound lens according to claim 14, further comprising:

c) a conical portion coupled to said lower parabolic portion.

17. A sound lens according to claim 14, wherein:

said sound lens is provided with a lower lip.

18. A sound lens according to claim 14, further comprising:

c) an internal baffle formed integrally with said upper and lower parabolic portions.

19. A sound lens according to claim 14, further comprising:

c) an internal baffle, wherein said upper and lower parabolic portions are provided with an interior surface and said internal baffle is coupled to said interior surface.

20. A sound lens according to claim 14, further comprising:

c) a means for mounting said sound lens relative to a means for generating sound.

21. A sound lens speaker system, comprising:

a) a concave sound lens having an upper parabolic portion having an upper concave surface and a lower parabolic portion having a lower concave surface, a cross-section through a center of said upper parabolic portion being defined by a first parabolic equation, said upper parabolic portion being defined by revolution of a portion of a first parabola defined by said first parabolic equation about an axis of said first parabola, and a cross-section through a center portion of said lower parabolic portion being defined by a second parabolic equation different than said first parabolic equation, said lower parabolic portion being defined by revolution of a portion of a second parabola defined by said second parabolic equation about an axis of said second parabola; and b) at least one speaker driver for emitting sound waves onto at least one of said upper and lower concave surfaces of said upper and lower parabolic portions.

22. A sound lens speaker system according to claim 21, wherein:

said axis of said first parabola and said axis of said second parabola are substantially coaxial.

* * * * *